US008800469B2

(12) United States Patent
Musacchio

(10) Patent No.: US 8,800,469 B2
(45) Date of Patent: Aug. 12, 2014

(54) BOAT COVER

(75) Inventor: Nicholas Musacchio, Cypress, CA (US)

(73) Assignee: Yamaha Motor Corporation, USA, Cypress, CA (US)

( * ) Notice: Subject to any disclaimer, the term of this patent is extended or adjusted under 35 U.S.C. 154(b) by 47 days.

(21) Appl. No.: 13/559,926

(22) Filed: Jul. 27, 2012

(65) Prior Publication Data

US 2014/0026803 A1 Jan. 30, 2014

(51) Int. Cl.
*B63B 17/02* (2006.01)

(52) U.S. Cl.
USPC ..... 114/361; 135/119

(58) Field of Classification Search
USPC ..... 114/361, 364; 135/99, 117, 119, 125
See application file for complete search history.

(56) References Cited

U.S. PATENT DOCUMENTS

| | | | | |
|---|---|---|---|---|
| 3,896,832 | A * | 7/1975 | Montoya | 114/361 |
| 4,075,723 | A * | 2/1978 | Bareis et al. | 114/361 |
| 5,706,752 | A | 1/1998 | Menne, Jr. et al. | |
| 5,803,104 | A | 9/1998 | Pollen | |
| 6,032,694 | A | 3/2000 | Wellen et al. | |
| 6,151,756 | A | 11/2000 | Czipri | |
| 6,308,653 | B1 * | 10/2001 | Geraci | 114/361 |
| 6,327,993 | B1 | 12/2001 | Richens, Jr. | |
| 6,907,642 | B1 | 6/2005 | Czipri | |
| 6,945,188 | B2 * | 9/2005 | Eck et al. | 114/361 |
| 6,983,716 | B1 | 1/2006 | Ankney et al. | |
| 7,011,346 | B2 | 3/2006 | James, Sr. | |
| 7,040,587 | B2 | 5/2006 | Thompson et al. | |
| 7,107,926 | B2 | 9/2006 | Fishburn | |
| 7,162,968 | B2 | 1/2007 | Thompson | |
| 7,334,822 | B1 | 2/2008 | Hines, Jr. | |
| 7,357,094 | B2 | 4/2008 | Burnley et al. | |
| 7,430,980 | B2 | 10/2008 | Fishburn | |
| 7,571,691 | B2 | 8/2009 | Russikoff | |
| 7,647,879 | B2 * | 1/2010 | del Valle Bravo et al. | 114/361 |
| 7,677,613 | B2 | 3/2010 | Chermanski | |
| 7,921,797 | B2 | 4/2011 | James | |
| 7,950,342 | B2 | 5/2011 | Russikoff | |
| 8,056,495 | B2 | 11/2011 | Lemons | |
| 2002/0053313 | A1 | 5/2002 | Murphy et al. | |
| 2005/0012004 | A1 | 1/2005 | Thompson et al. | |
| 2006/0028022 | A1 | 2/2006 | James | |
| 2006/0090685 | A1 | 5/2006 | Fishburn | |
| 2006/0090686 | A1 | 5/2006 | Thompson | |
| 2006/0278801 | A1 | 12/2006 | Burnley et al. | |
| 2007/0295263 | A1 | 12/2007 | Fishburn | |
| 2008/0011217 | A1 | 1/2008 | Russikoff | |
| 2008/0223280 | A1 | 9/2008 | Kemmer | |
| 2008/0244820 | A1 | 10/2008 | Moore | |
| 2008/0314306 | A1 | 12/2008 | Santa Cruz et al. | |
| 2009/0189038 | A1 | 7/2009 | James | |
| 2009/0229508 | A1 | 9/2009 | James | |
| 2009/0302606 | A1 | 12/2009 | Chermanski | |
| 2009/0320738 | A1 | 12/2009 | Blumberg | |
| 2010/0050923 | A1 | 3/2010 | Lemons | |
| 2010/0083891 | A1 | 4/2010 | Russikoff | |
| 2010/0319602 | A1 | 12/2010 | Walczak | |
| 2011/0278335 | A1 | 11/2011 | Jesewitz et al. | |

* cited by examiner

*Primary Examiner* — Lars A Olson
(74) *Attorney, Agent, or Firm* — Keating & Bennett, LLP

(57) ABSTRACT

A boat cover for being attached to a boat includes a canvas, at least one pole supporting the canvas, and at least one strap. The boat cover is arranged to be attached to the boat only using the at least one strap.

24 Claims, 8 Drawing Sheets

BOAT COVER

BACKGROUND OF THE INVENTION

1. Field of the Invention

The present invention relates to a boat cover that is also known as a Bimini top. More specifically, the present invention relates to a boat cover that can be easily and quickly removed from a boat without a lot of hardware.

2. Description of the Related Art

Known boat covers include Bimini tops. Conventional Bimini tops include an open-front canvas top covering a cockpit of a boat. Conventional Bimini tops are usually supported by a metal frame that is attached to the boat. Such Bimini tops can be collapsed when not in use and raised again if shade or shelter is desired for the boat's cockpit. See, for example, U.S. Pat. Nos. 5,706,752 and 5,803,104.

Conventional Bimini tops only protect an area around the boat's cockpit from the sun and from rain, if the boat is stationary and there is not any wind. Conventional Bimini tops require permanent hardware, for example, brackets and other similar hardware, to be attached to the boat. That is, conventional Bimini tops are only used for a single boat, i.e. the boat that they are attached to. Further, conventional Bimini tops cannot easily be removed from a boat and stored.

SUMMARY OF THE INVENTION

To overcome the problems described above, preferred embodiments of the present invention provide a boat cover that can be easily and quickly removed from a boat without a lot of hardware. Boat covers of the preferred embodiments of the present invention require no permanent hardware to be attached to a boat so that the boat cover can be packed up and easily stored and can be used for multiple boats.

A boat cover for being attached to a boat according to a preferred embodiment of the present invention includes a canvas, at least one pole supporting the canvas, and at least one strap. The boat cover is arranged to be attached to the boat only using the at least one strap.

The canvas preferably includes at least two pockets, and the ends of the at least one pole preferably engage the at least two pockets. The canvas preferably includes at least one flap, and the at least one pole is preferably inserted through the at least one flap. The boat cover preferably further includes a hole that is arranged such that a tow lug of a tower of the boat can be inserted into the hole when the boat cover is attached to the boat.

The boat cover preferably further includes at least one stabilizing pole. A length of the at least one stabilizing pole is preferably adjustable. The at least one stabilizing pole preferably includes a smaller diameter pole located within a bigger diameter pole and a screw or other fastening member that is arranged to fix the smaller diameter pole and the bigger diameter pole with respect to each other. The at least one pole preferably includes two poles, and the two poles preferably cross each other.

A boat according to a preferred embodiments of the present invention includes a tower and a boat cover as described above. The at least one strap is preferably tied to the tower. The tower is preferably a wakeboard tower. The boat preferably further includes at least one cleat, where the at least one strap is tied to the at least one cleat. The tower preferably includes a tow lug; the boat cover preferably includes a hole; and the tow lug is preferably located within the hole.

A boat according to a preferred embodiment of the present invention includes a tower, and a boat cover including a canvas, at least one pole supporting the canvas, and at least one strap. The boat cover is preferably arranged to cover a top of the tower and to be attached to the boat by the at least one strap.

The boat cover preferably fully covers the top of the tower, and the at least one pole preferably includes a pole that is located above the top of the tower. The at least one pole preferably includes two poles that cross each other at a location above the top of the tower. The at least one pole preferably includes a center pole that extends in a direction perpendicular or substantially perpendicular to a fore-and-aft centerline of the boat.

A boat cover for being attached to a boat according to a preferred embodiment of the present invention includes a canvas including at least six pockets and at least three flaps; at least three poles supporting the canvas, each of the at least three poles inserted through one of the at least three flaps and including ends that engage two of the at least six pockets; and at least one strap. The boat cover is arranged to be attached to the boat using the at least one strap, and the at least three poles cross each other.

The boat cover preferably further includes at least one stabilizing pole. The length of the at least one stabilizing pole is preferably adjustable. The at least one stabilizing pole preferably includes a smaller diameter pole located within a bigger diameter pole and a screw or other fastening member that is arranged to fix the smaller diameter pole and the bigger diameter pole with respect to each other.

The above and other features, elements, characteristics, configurations, arrangements and advantages of the present invention will become more apparent from the following detailed description of preferred embodiments of the present invention with reference to the attached drawings.

DETAILED DESCRIPTION OF PREFERRED EMBODIMENTS

FIGS. 1-8 show a boat cover 10 according to preferred embodiments of the present invention. The boat cover 10 is used to cover the occupants of a boat 20, for example, to provide shade for the occupants of the boat 20. The boat cover 10 is preferably used when the boat 20 is not moving or not moving very fast. The boat cover 10 is preferably used with a boat 20 having a boat tower 22. The boat tower 20 is preferably a wakeboard tower for towing a wakeboarder.

Figure 1:
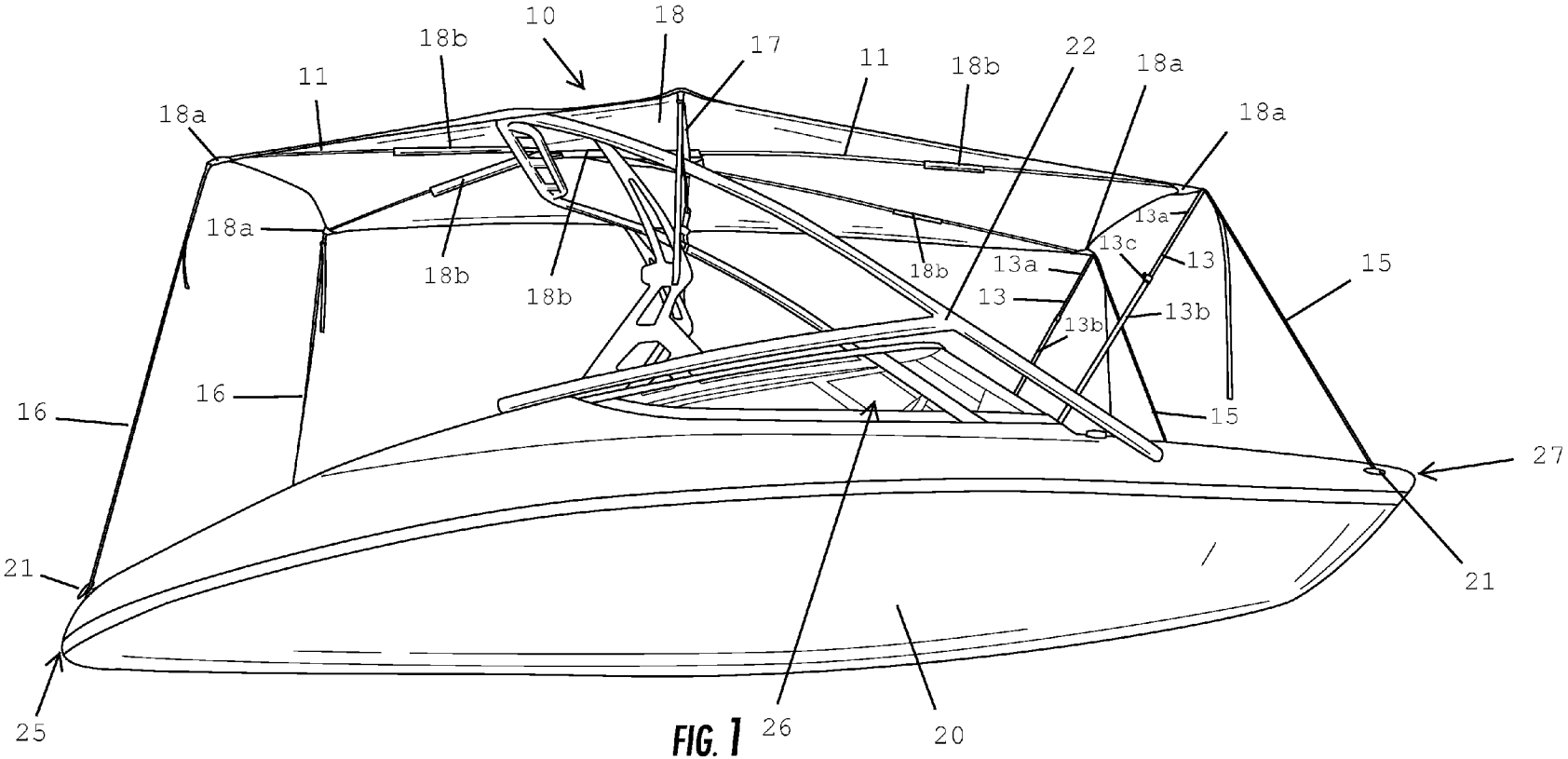
FIG. 1 is a side view of a boat cover according to a preferred embodiment of the present invention attached to a boat.
Figure 2:
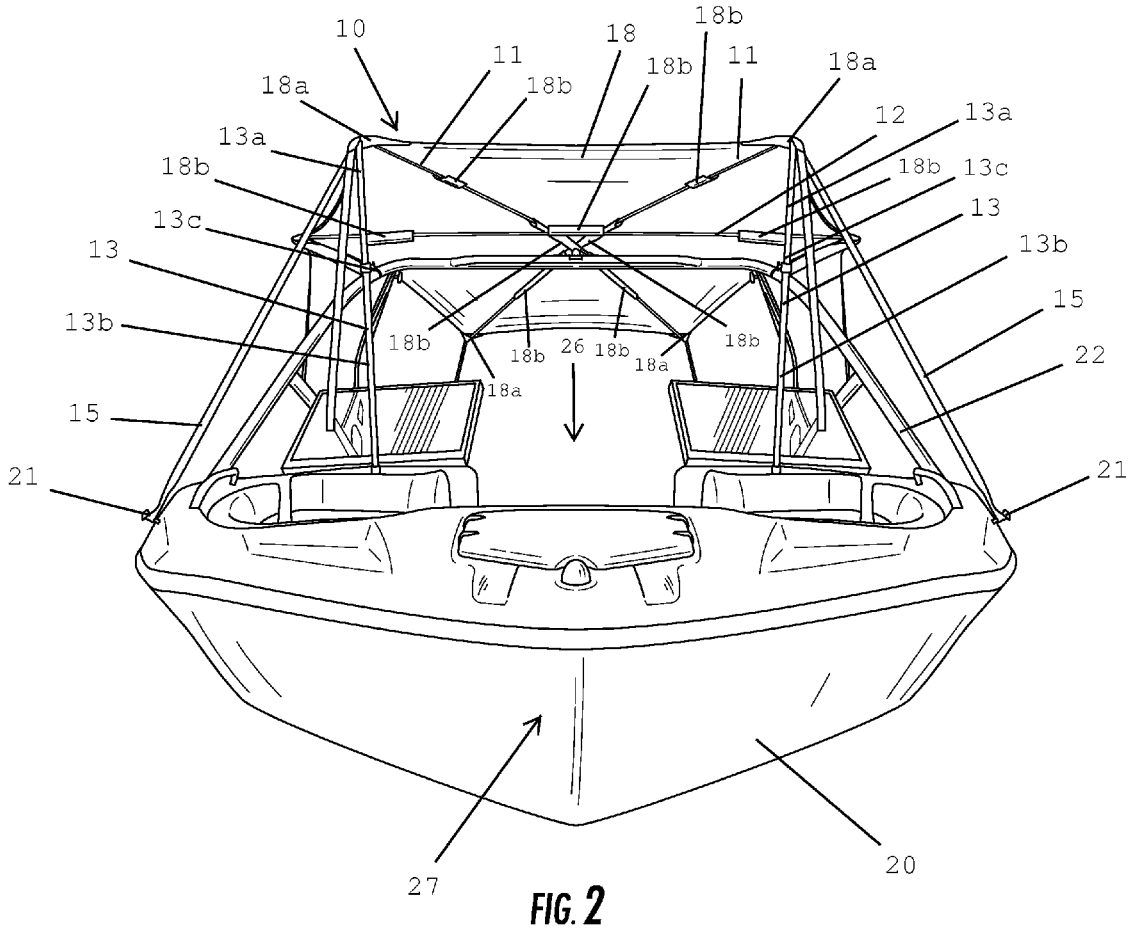
FIG. 2 is a front view of a boat cover according to a preferred embodiment of the present invention attached to a boat.
Figure 3:
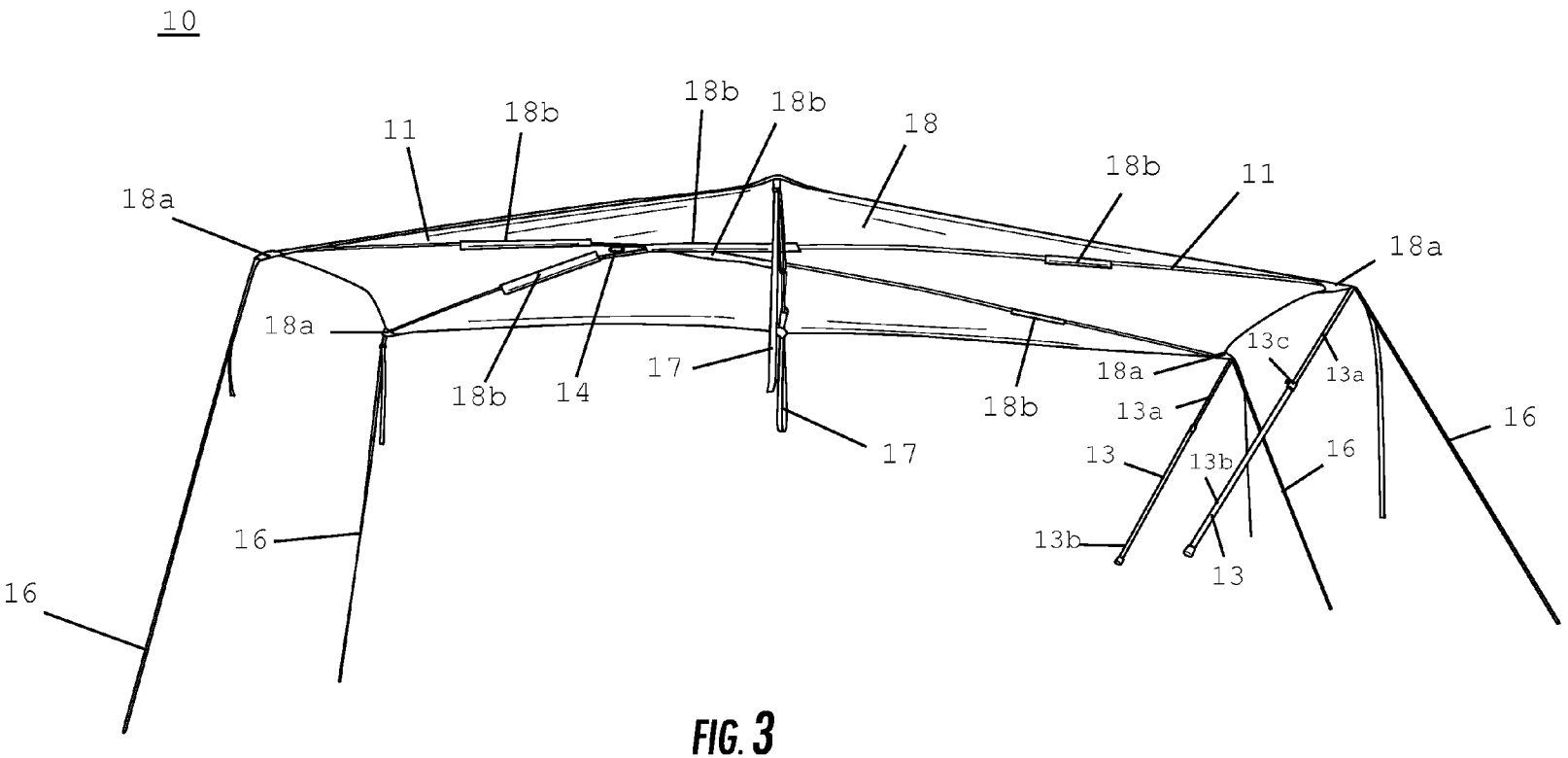
FIG. 3 is a side view of a boat cover according to a preferred embodiment of the present invention.
Figure 6:
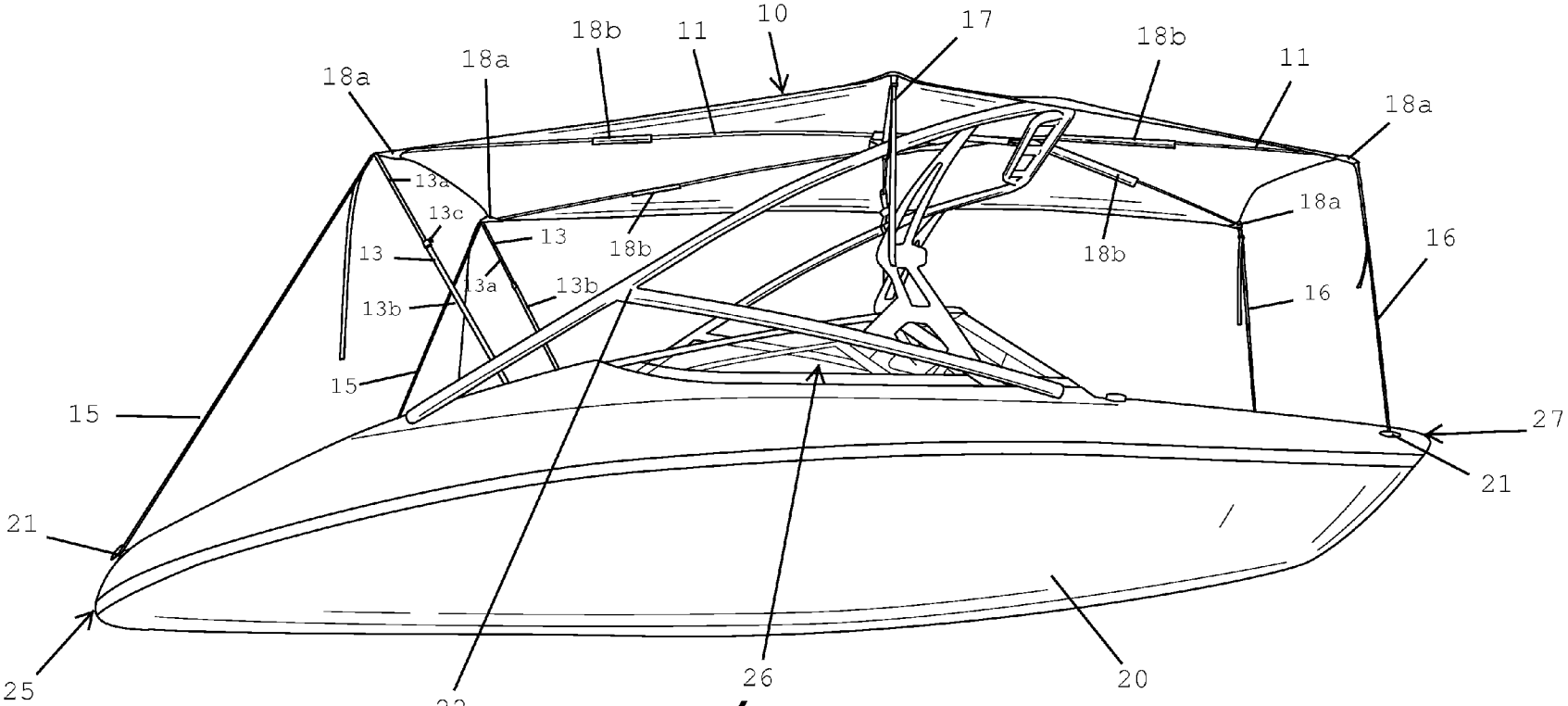
FIG. 6 is a side view of a boat cover according to a preferred embodiment of the present invention attached to a boat in another arrangement.

The features and elements of the boat cover 10 according to preferred embodiments of the present invention will be described with respect to the orientation of the boat 20 shown FIGS. 1 and 2. Thus, the use of directional terms such as fore and aft will be with respect to orientation of the boat 20 shown FIGS. 1 and 2. For example, the term "fore" in fore straps 15 is used to indicate that fore straps 15 are located at the front of the boat 20 as seen in FIGS. 1 and 2. However, these directional terms are used for description purposes only and are not intended to be limiting. For example, as seen in FIG. 6 in which the orientation of the boat cover 10 with respect to the boat 20 is reversed, the fore straps 15 can be located at the rear of the boat 20.

Figure 7:
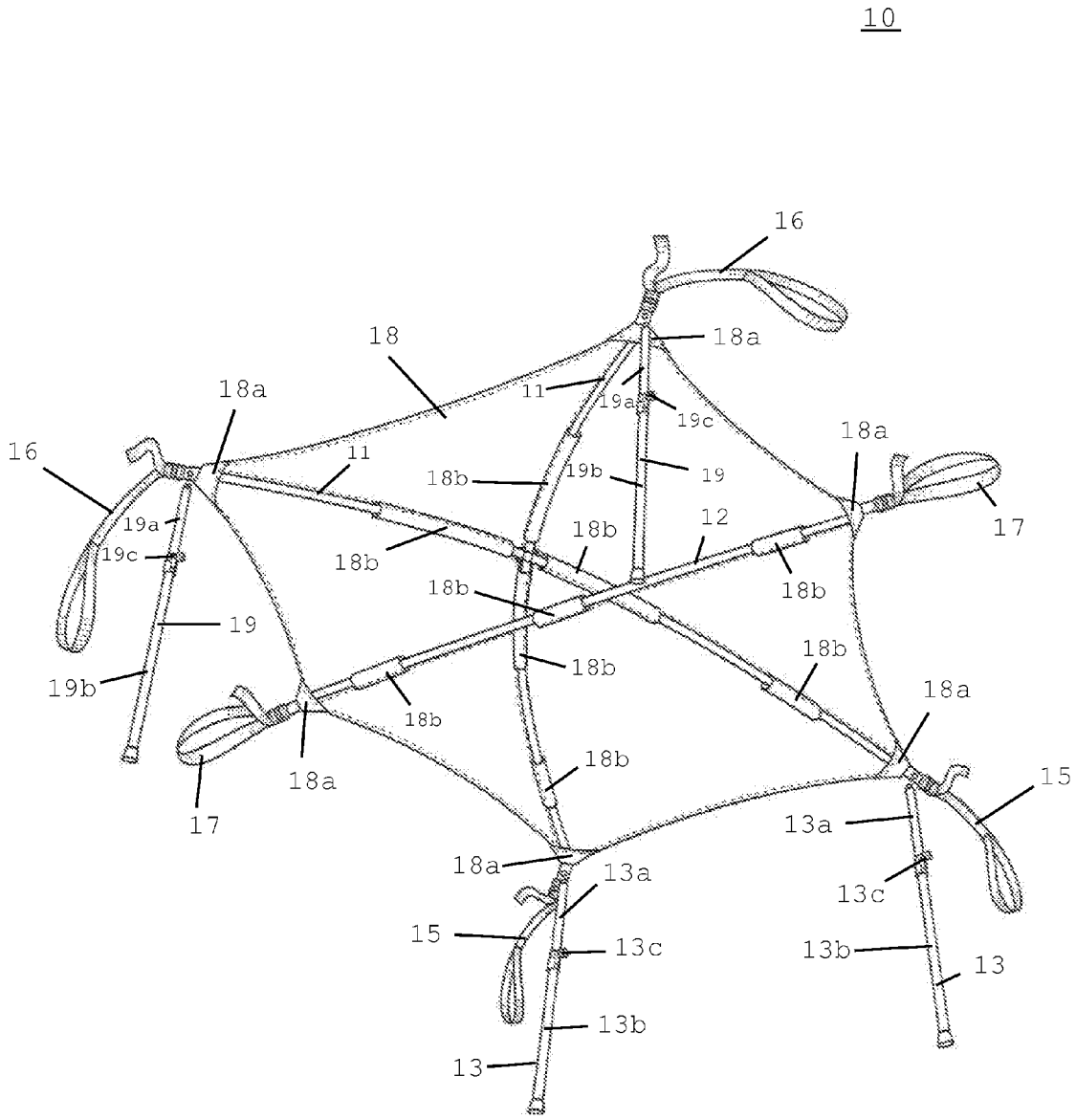
FIG. 7 is bottom perspective view of a boat cover according to a preferred embodiment of the present invention.
Figure 8:
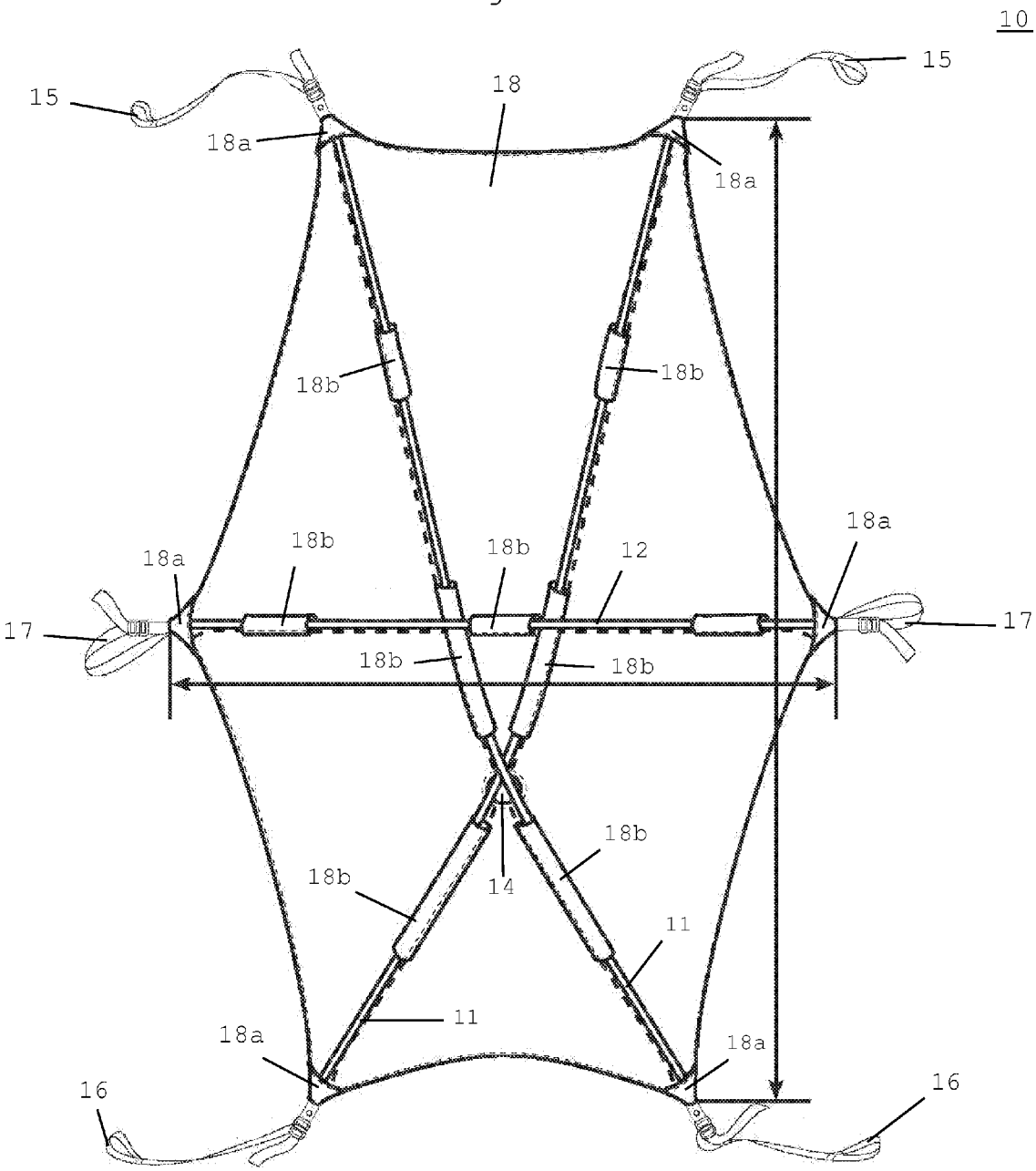
FIG. 8 is a bottom plan view of a boat cover according to a preferred embodiment of the present invention

As seen in FIGS. 7 and 8 without the boat 20, the boat cover 10 preferably includes two fore-to-aft poles 11, a center pole 12, two fore poles 13, two fore straps 15, two aft straps 16, two center straps 17, and a canvas 18.

Canvas 18 is preferably made of any suitable material, including cotton, nylon, or polyester. The canvas 18 preferably includes a hole 14, pockets 18*a*, and flaps 18*b*. The canvas 18 is preferably large enough to cover the cockpit 26 of the boat 20 and areas near the cockpit but toward the stern 25 and the bow 27 of the boat 20. Thus, the boat cover 10 is able to provide more cover than traditional Bimini tops that only cover a boat's cockpit.

The hole 14 is preferably located along the fore-and-aft centerline of the boat 20 and is preferably located between the stern 25 of the boat 20 and the center of boat cover 10 so that ratio of the distance from the hole 14 to fore most portion of the boat cover 10 along the fore-and-aft centerline to the distance from the hole 14 to the aft most portion of the boat cover 10 along the fore-and-aft centerline is preferably in the range of about 1:1 to about 4:1, more preferably in the range of about 3:1 to about 4:1.

Figure 4:
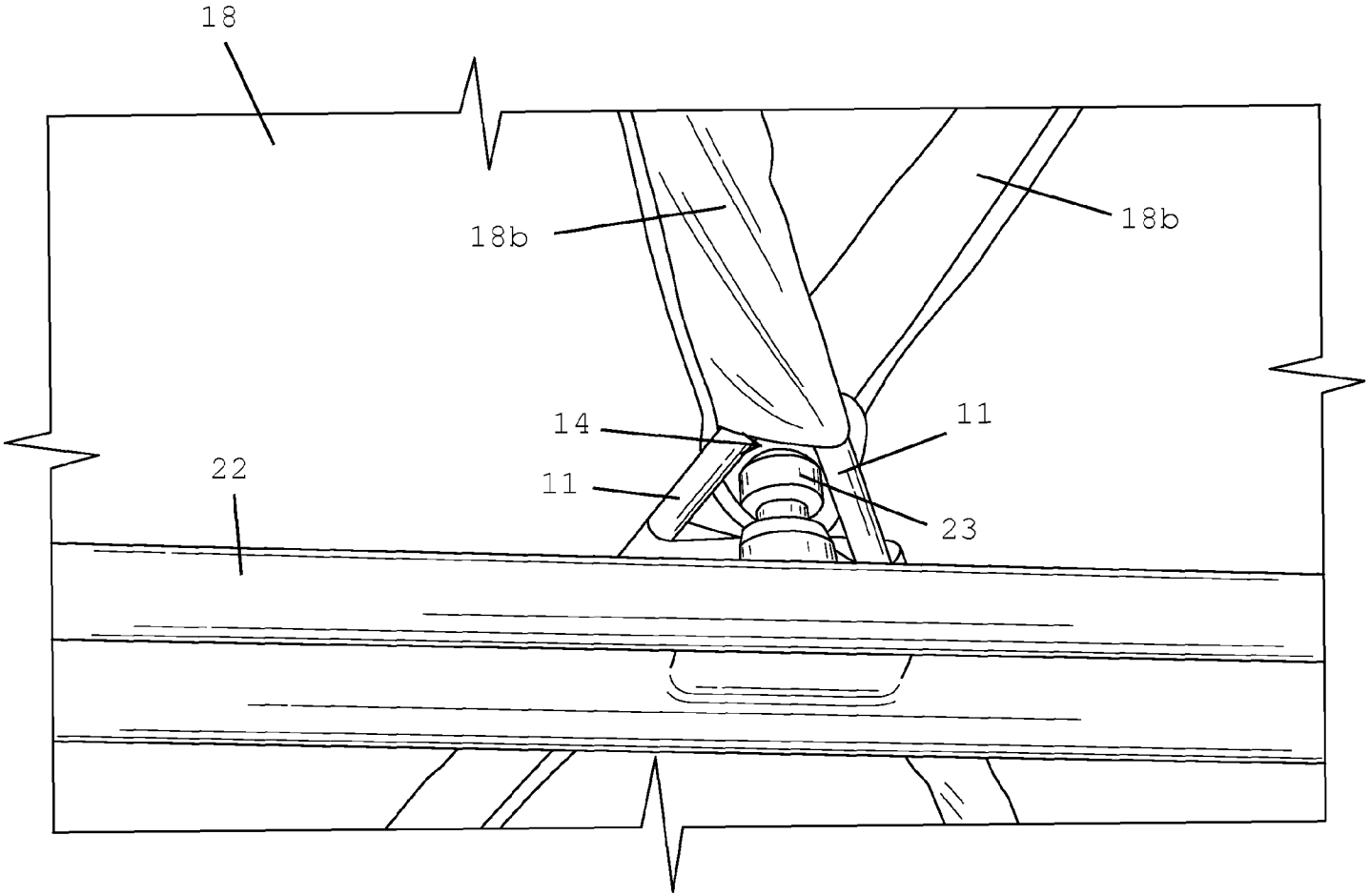
FIG. 4 is a close-up view of a portion boat cover according to a preferred embodiment of the present invention.
Figure 5:
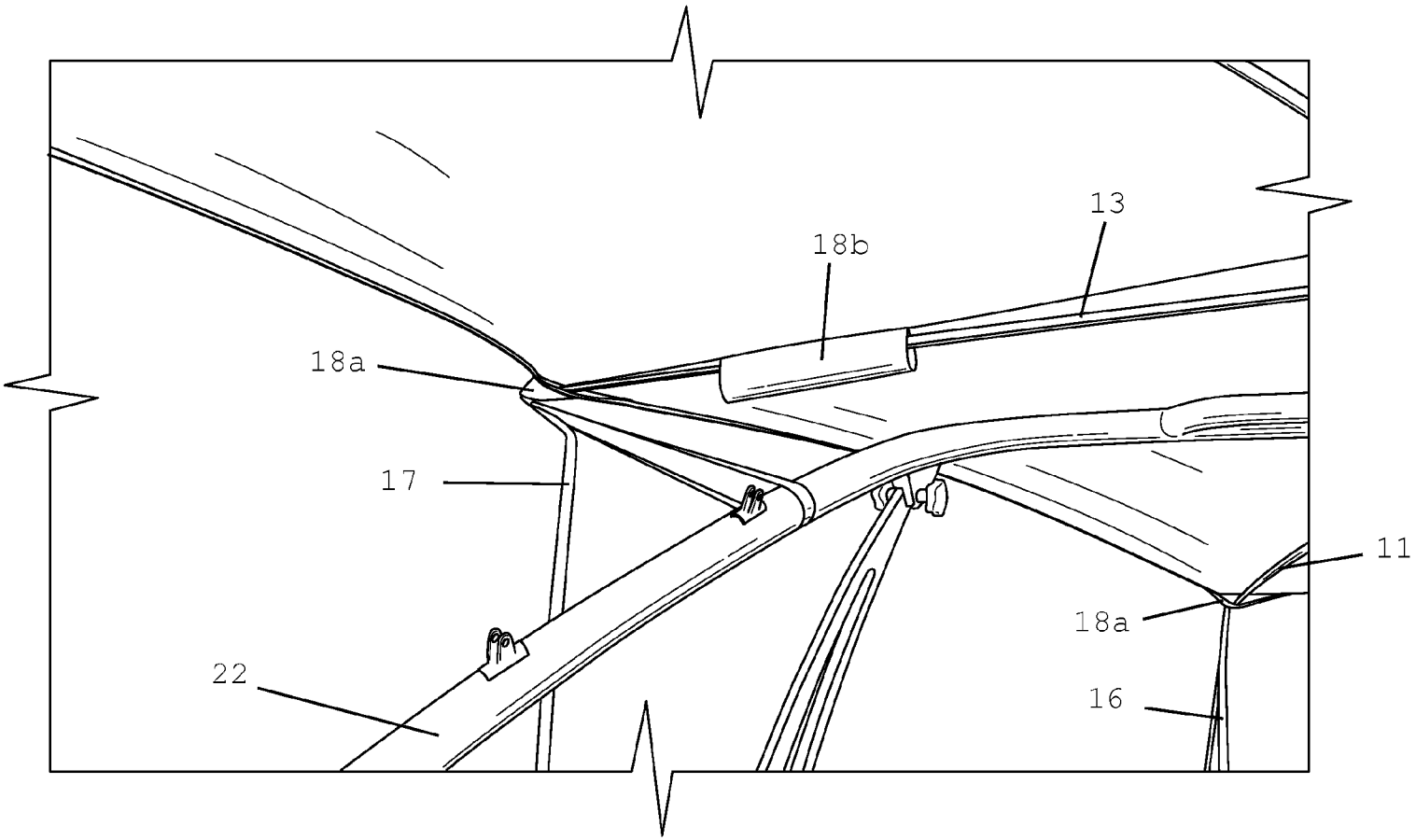
FIG. 5 is a close-up view of a portion boat cover according to a preferred embodiment of the present invention.

The tow lug 23 of the tower 22 is preferably inserted in the hole 14 as seen in the close-up view shown in FIG. 4. Instead of a single hole 14, it is possible to have no hole or more than one hole. For example, it is possible to use a boat cover 10 with no holes for boats 20 with a tower 22 but without a tow lug 23, and it is also possible to use a boat cover 10 with multiple holes for boats 20 with a tower 22 with multiple holes 20. It is also possible to use a boat cover with one or more holes 20 with boats 20 with towers 22 with no tow lugs 23, in which case no tow lugs 23 will be inserted into the one or more holes 14. It also possible to use a boat cover 10 without holes 14 with boats 20 with towers 22 with one or more tow lugs 23, in which case the one or more tow lugs 23 will engage the canvas 18, possibly distorting the shape of the canvas 18. The canvas 18 is preferably supported by the tower 22, and is restrained from moving by the hole 14 engaging the tow lug 23. The boat cover 10 can be used with a tower 22 even if the tower already has a Bimini top (not shown in the drawings). Because the boat cover 10 provides more cover, it is sometimes desirable to use the boat cover 10, even if the tower 22 includes a Bimini top. If the tower 22 includes a Bimini top, then the boat cover 10 preferably extends over the Bimini top in both the fore and aft directions.

As seen in FIGS. 1-5, 7, and 8, the pockets 18*a* and the flaps 18*b* hold in place the fore-to-aft poles 11 and the center pole 12 so that the canvas 18 is taut, with little or no slack. The fore-to-aft poles 11 generally extend in a direction parallel or substantially parallel to the fore-and-aft centerline of the boat 20, and the center pole 12 extends in a direction perpendicular or substantially perpendicular to the fore-and-aft centerline of the boat 20. Preferably there are two pockets 18*a* and two flaps 18*b* for the center pole 12, and there are two pockets 18*a* and three flaps 18*b* for each of the fore-to-aft poles 11, for example. Each of the fore-to-aft poles 11 and the center pole 12 is inserted through the corresponding flaps 18*b* (for example, preferably two for the center pole 12 and three for the for-to-aft poles 11), and then both ends of each of the fore-to-aft poles 11 and center pole 12 are inserted into a corresponding pocket 18*a*, which causes the canvas 18 to be taut, as shown, for example, in the close-up view of FIG. 5. The flaps 18*b* are preferably arranged such that the fore-to-aft poles 11 are located above the center pole 12 when the boat cover 10 is attached to the boat 20. Instead of using pockets 18*a*, it is possible use any other suitable structure to hold the poles 11, 12 in position. For example, instead of pockets 18*a*, it is possible to use grommets that engage with a corresponding smaller diameter portion of the poles that prevent the longitudinal movement of the poles. Instead of flaps 18*b*, it is possible to use hooks, fabric or rope sewn into the canvas 18 that can be tied around the poles, or open flaps that can be closed around the poles using Velcro® to prevent lateral movement of the poles.

The two fore-to-aft poles 11 preferably cross each other near the hole 14; however, it possible that the two fore-to-aft poles 11 do not cross each other. The poles 11 preferably have a linear or substantially linear shape when held by the pockets 18*a* and flaps 18*b*; however, it also possible that the poles have a different shape. For example, it possible that the pockets 18*a* and flaps 18*b* are arranged such that the one or more of the poles 11, 12 has or have a semicircular or substantially semicircular shape when held by the pockets 18*a* and flaps 18*b*. Although three poles are shown in FIGS. 1-6, it possible to use a different number of poles. For example, only two poles could be used or four or more poles could be used. If the number of poles is changed, then the shape of the canvas 18 might also be changed. For example, if only two poles are used, then it would be preferable the canvas 18 have a convex shape along each of the outer edges of the canvas 18 so that the two poles can keep the canvas 18 taut.

The poles are preferably made of metal and/or fiber glass; however, any other suitable material, such as plastic or composite materials including carbon fiber, can also be used. The poles preferably can be separated into smaller pieces so that the poles can be easily stored in a bag or other suitable container. The smaller pieces are preferably connected to each other by an elastic cord that keeps the smaller pieces connected together when arranged as the poles but allows the smaller pieces to be easily separated from each other when taking down the boat cover 10. The elastic cord allows for easy assembly of the smaller pieces into the poles because all of the smaller pieces are kept together.

The canvas 18 is preferably attached to the boat 20 using the two fore straps 15, the two aft straps 16, and the two center straps 17. One end of the two fore straps 15, the two aft straps 16, and the two center straps 17 is preferably sewn to the edges of the canvas 18. The other end of the two fore straps 15 and the two aft straps 16 are preferably tied to the fore and aft cleats 21 on the boat 20, and the other end of the two center straps 17 is preferably tied to the tower 22 as shown in the close-up view of FIG. 5. Although six straps are shown in FIGS. 1-3 and 6, any number of straps could be used. The straps do not have to be tied to the cleats 21 and the tower 22 and can be tied to other parts of the boat 20, including, for example, any suitable railing or hand holds on the boat 20.

Although the boat cover 10 is supported by the tower 22, the boat cover 10 is only attached to the boat 20 using the straps. It is not necessary to add additional hardware, e.g. permanent brackets, to the boat 20 to attach the boat cover 10 to the boat 20. Because no additional hardware is needed, it is possible to use the boat cover 10 with any boat with a boat tower. It is also possible to pack up the boat cover 10 and to use the boat cover 10 on different boats.

The straps 15-17 are preferably adjustable so that after the straps 15-17 have been tied to the boat, the tension in the straps 15-17 can be adjusted. Instead of straps, the canvas 18 could be attached to the boat 20 using any other suitable device, including, for example, rope or bungee cords.

The boat cover 10 can also include two fore poles 13 to stabilize the boat cover 10. One end of the fore poles 13 preferably engages a grommet near the pockets 18*a* near the bow 27 of the boat 10, and the other end of the fore poles 13 engages a surface of the boat 20. Any surface of the boat 20 can be used that helps stabilize the boat cover 10. The length of the fore poles 13 is preferably adjustable. For example, the fore poles 13 can include a smaller diameter pole 13*a* inside a bigger diameter pole 13*b* that can be fixed with respect to each other by a screw 13*c*. The fore poles 13 can also be adjustable using telescoping poles with cam locks with a locking lever, locking nut, or snapping push-buttons, for example.

As shown in FIGS. 1-3 and 5, the boat cover 10 is stabilized preferably by two fore poles 13, for example. However, it is possible to use any number of stabilizing poles. For example, it is possible to use no stabilizing poles, for example, if the hole 14 is located near center of the canvas 18. If the boat 20 does not include a tower 22, then additional stabilizing poles can be used to support the center of the boat cover 10. In addition, two aft poles 19 can be used to stabilize the aft portion of the boat cover 10, as shown in FIG. 7. The two aft poles 19 can be used in cooperation with aft straps 16 to stabilize the aft portion of the boat cover 10 in a manner similar to how the fore poles 13 are used in cooperation with the fore straps 15 to stabilize the fore portion of the boat cover 10. As with the fore poles 13, the length of the aft poles 19 is preferably adjustable. For example, the aft poles 19 can include a smaller diameter pole 19*a* inside a bigger diameter pole 19*b* that can be fixed with respect to each other by a screw 19*c* or other fastening member. As with the fore poles 13, the aft poles can also be adjustable using telescoping poles with cam locks with a locking lever, locking nut, or snapping push-buttons, for example.

FIG. 6 shows the boat cover 10 in a different arrangement with respect to the boat 20. The boat 20 in FIG. 6 includes a tower 22 that sweeps forward instead of backwards as shown in FIGS. 1 and 2. Because the tower 22 sweeps forward in FIG. 6, the tow lug 23 (not shown in FIG. 6) of the tower 22 is located toward the bow 27 of the boat 20. Accordingly, the orientation of the boat cover 10 is reversed so that the hole 14 is also located toward the bow 27 of the boat 20.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A boat cover for being attached to a boat comprising:
a canvas;
at least one pole supporting the canvas; and
at least one strap; wherein
the boat cover is arranged to be attached to the boat only using the at least one strap; and
the canvas extends substantially horizontally and does not contact a hull of the boat.

2. A boat cover according to claim 1, wherein:
the canvas includes at least two pockets; and
ends of the at least one pole engage the at least two pockets.

3. A boat cover according to claim 1, wherein:
the canvas includes at least one flap; and
the at least one pole is inserted through the at least one flap.

4. A boat cover according to claim 1, further comprising a hole that is arranged such that a tow lug of a tower of the boat can be inserted into the hole when the boat cover is attached to the boat.

5. A boat cover according to claim 1, further comprising at least one stabilizing pole.

6. A boat cover according to claim 5, wherein a length of the at least one stabilizing pole is adjustable.

7. A boat cover according to claim 5, wherein the at least one stabilizing pole includes:
a smaller diameter pole located within a bigger diameter pole; and
a screw that is arranged to fix the smaller diameter pole and the bigger diameter pole with respect to each other.

8. A boat cover according to claim 1, wherein:
the at least one pole includes two poles; and
the two poles cross each other.

9. A boat comprising:
a tower; and
a boat cover according to claim 1.

10. A boat comprising:
a tower; and
a boat cover attached to the boat, the boat cover including:
a canvas;
at least one pole supporting the canvas; and
at least one strap; wherein
the boat cover is arranged to be attached to the boat only using the at least one strap; and
the at least one strap is tied to the tower.

11. A boat according to claim 9, wherein the tower is a wakeboard tower.

12. A boat comprising:
a tower; and
a boat cover attached to the boat, the boat cover including:
a canvas;
at least one pole supporting the canvas; and
at least one strap; wherein
the boat cover is arranged to be attached to the boat only using the at least one strap;
the boat includes at least one cleat; and
the at least one strap is tied to the at least one cleat.

13. A boat according to claim 9, wherein:
the tower includes a tow lug;
the boat cover includes a hole; and
the tow lug is located within the hole.

14. A boat comprising:
a tower; and
a boat cover including:
a canvas;
at least two poles supporting the canvas; and
at least one strap; wherein
the boat cover is arranged to cover a top of the tower and to be attached to the boat by the at least one strap; and
the at least two poles extend substantially horizontally, cross each other, and do not contact a hull of the boat.

15. A boat comprising:

a tower; and a boat cover including:

a canvas;

at least one pole supporting the canvas; and at least one strap; wherein the boat cover is arranged to cover a top of the tower and to be attached to the boat by the at least one strap;

the boat cover fully covers the top of the tower; and the at least one pole includes a pole that is located above the top of the tower.

16. A boat comprising:

a tower; and a boat cover including:

a canvas;

at least one pole supporting the canvas; and at least one strap; wherein the boat cover is arranged to cover a top of the tower and to be attached to the boat by the at least one strap; and the at least one pole includes two poles that cross each other at a location above the top of the tower.

17. A boat according to claim 14, wherein the at least one pole includes a center pole that extends in a direction perpendicular or substantially perpendicular to a fore-and-aft centerline of the boat.

18. A boat cover for being attached to a boat comprising:

a canvas including at least six pockets and at least three flaps;

at least three poles supporting the canvas, each of the at least three poles inserted through one of the at least three flaps and including ends that engage two of the at least six pockets;

at least one strap; wherein the boat cover is arranged to be attached to the boat using the at least one strap; and the at least three poles cross each other.

19. A boat cover according to claim 18, further comprising at least one stabilizing pole.

20. A boat cover according to claim 19, wherein a length of the at least one stabilizing pole is adjustable.

21. A boat cover according to claim 19, wherein the at least one stabilizing pole includes:

a smaller diameter pole located within a bigger diameter pole; and a screw that is arranged to fix the smaller diameter pole and the bigger diameter pole with respect to each other.

22. A boat cover according to claim 14, wherein the at least one pole generally extends in a fore-to-aft direction of the boat.

23. A boat cover for being attached to a boat comprising:

a canvas;

at least one pole supporting the canvas; and at least one strap; wherein the boat cover is arranged to be attached to the boat only using the at least one strap; and the at least one pole extends substantially horizontally and neither of the canvas and the at least one pole contacts a hull of the boat.

24. A boat cover for being attached to a boat comprising:

a canvas;

at least two poles supporting the canvas; and at least one strap; wherein the boat cover is arranged to be attached to the boat only using the at least one strap; and the at least two poles extend substantially horizontally, cross each other, and do not contact a hull of the boat.

* * * * *